US005445244A

United States Patent [19]

Ketonen

[11] Patent Number: 5,445,244

[45] Date of Patent: Aug. 29, 1995

[54] SYSTEM FOR FORMING THE JAMBS FOR THE LANDING DOORS OF AN ELEVATOR

[75] Inventor: Ari Ketonen, Hyvinkää , Finland

[73] Assignee: Kone Oy, Helsinki, Finland

[21] Appl. No.: 229,774

[22] Filed: Apr. 19, 1994

[30] Foreign Application Priority Data

Apr. 23, 1993 [FI] Finland ..... 931859

[51] Int. Cl.[6] ..... B66B 13/00

[52] U.S. Cl. ..... 187/325; 187/336; 187/414

[58] Field of Search ..... 187/325, 336, 414

[56] References Cited

U.S. PATENT DOCUMENTS 3,740,907 6/1973 Loomis .
4,530,189 7/1985 Randall ..... 187/1 R X

FOREIGN PATENT DOCUMENTS 0036686 3/1981 European Pat. Off. .
2120596 1/1971 France .
2211389 12/1972 France .
2239087 9/1990 Japan ..... 187/1 R X
2239088 9/1990 Japan ..... 187/1 R X
4173689 6/1992 Japan ..... 187/1 R X
99740 2/1962 Norway .
104748 7/1964 Norway .

*Primary Examiner*—William E. Terrell
*Assistant Examiner*—Dean A. Reichard

[57] ABSTRACT

The invention relates to a system for forming the jambs for elevator landing doors in a door opening (3) in the wall (2) between the elevator shaft and the landing. The jambs (4) consist of a skeletal structure (15,16,17) placed at the sides and at the top of the door opening and supporting the jamb structure, the skeletal structure being fastened to the wall by means of brackets (9) in a manner permitting adjustment in the direction of the plane of the door opening. Attached onto the skeletal structure is a surface structure (27,28) adjustable in the direction of the thickness of the wall. Each skeletal structure module is fixed to a bracket (9) in such a way that the position of the skeletal structure module can be adjusted in the direction of the plane of the door opening separately on the shaft side and on the landing side.

8 Claims, 5 Drawing Sheets

SYSTEM FOR FORMING THE JAMBS FOR THE LANDING DOORS OF AN ELEVATOR

The present invention relates to a system for forming the jambs for elevator landing doors.

Referring to any one of the three members constituting an elevator entrance frame, not only to the vertical side members of a door frame supporting a door.

BACKGROUND OF THE INVENTION

The openings for landing doors in the wall of an elevator shaft are usually made somewhat larger than the minimum size required for the installation of a door in the opening. This is because, in practical building work, inaccuracies inevitably occur, with the result that the actual positions of the doors differ somewhat from the designed ideal positions. In other words, the positions of the door openings on different floors differ horizontally from each other in relation to the vertical line of the elevator car. For the delivery and/or installation of the door jambs, this often involves drawbacks or difficulties such as the following, depending on the type of jambs used:

- The jambs have to be measured only after the installation of the landing doors and manufactured separately for each case.
- The builder cannot finish the building until after the jambs have been installed.
- Even jambs allowing adjustment require sawing and cutting of parts at the site of installation.
- Sending people to take door measurements on site is expensive.
- The material used in the doors looks different from jambs made locally, because the materials used often come from different suppliers or at least from different consignments.

SUMMARY OF THE INVENTION

To solve the problems described above, a new system for forming the jambs for elevator landing doors is presented as an invention. The system of the invention is characterized by what is presented in the characterization part of claim 1. Other embodiments of the invention are characterized by the features presented in the other claims. The advantages provided by the invention include the following:

- The structure of the invention allows the elevator doors and jambs to be ordered at the same time. As the jambs can be ordered without the elevator supplier visiting the site to take measurements, the costs associated with the delivery are lower.
- The structure of the invention allows simultaneous manufacturing of elevator doors and jambs.
- The doors and jambs can be installed at the final building stage because the builder can finish the walls before the elevator is installed.
- The solution of the invention is applicable for both board, concrete and brick walls.
- Differences in door and jamb materials can be avoided thanks to simultaneous manufacturing.
- Installation is simple and requires no special tools.
- The parts of the jamb structure have correct dimensions already at delivery from the factory.
- The elevator installation can be scheduled for a suitable time outside the critical course of the builder's time table because the finishing of the building is no longer dependent on the elevator installation. The time of installation of the elevator is substantially irrelevant as to when the wall surfaces can be finished.
- If desired, the fireproofing flashings or other insulation of equivalent nature between the door frame and the shaft wall as required by the fire safety regulations of some countries can be mounted independently of the installation of the entrance frame.

BRIEF DESCRIPTION OF THE DRAWINGS

In the following, the invention is described in detail by the aid of an embodiment by referring to the attached drawings, in which FIGS. 1–4 sequentially illustrate the progress of the installation of a jamb system according to the invention.

DETAILED DESCRIPTION OF THE INVENTION

Figure 1:
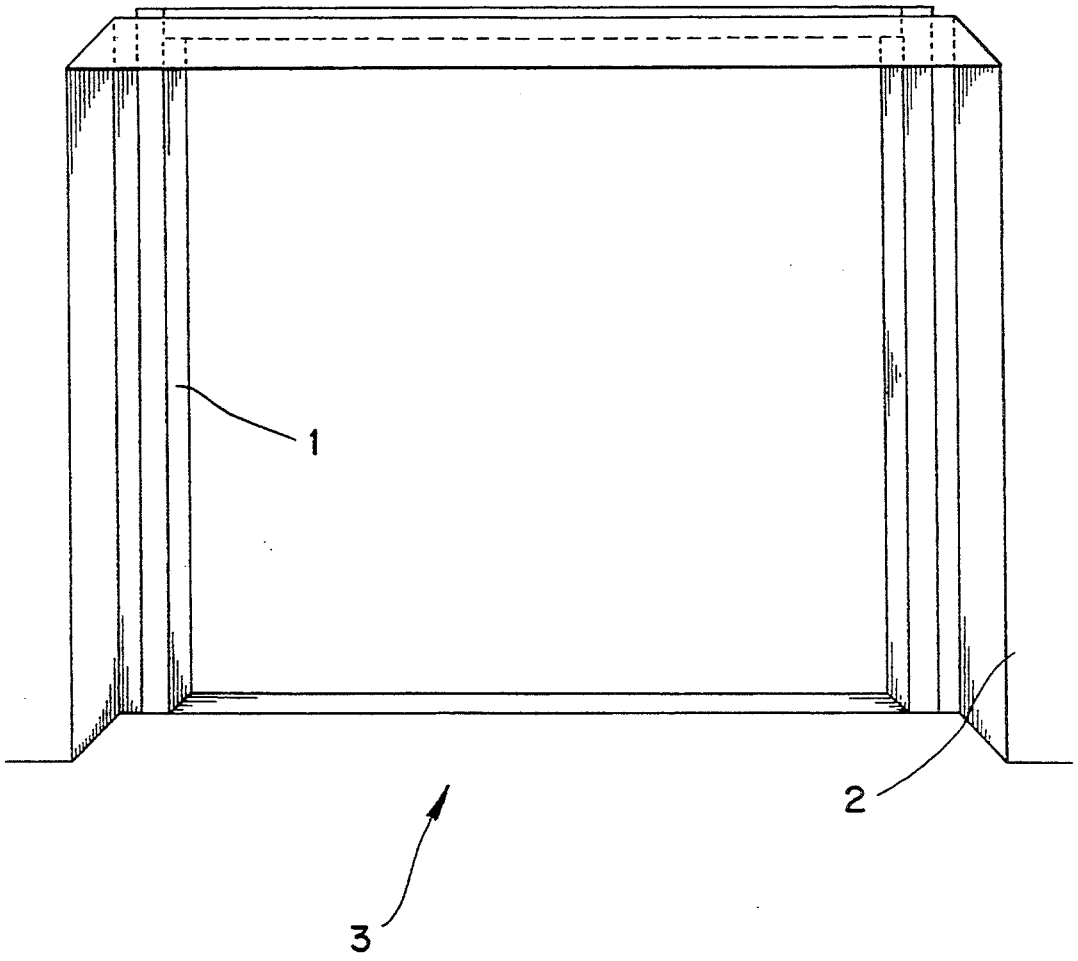

FIG. 1 shows the placement of the landing door frame 1 in relation to the opening 3 in the wall 2 of the elevator shaft. The landing door and its actuating mechanism are attached to the door frame structure 1. However, they are not shown in this figure. The frame is fixed to the shaft wall at least by its top and bottom parts (the attachment is not shown). The position of the door frame in the elevator shaft is determined according to the line of travel of the elevator car in question. Often the position of the frame 1 with respect to the opening 3 is set during the installation of the frame by making use of its adjustment tolerance. The line of travel of the elevator car is generally vertical. Due to the inaccuracies occurring in the construction of the elevator shaft and the openings for the landing doors, the distance of the door frame from the edges of the opening in the shaft wall in the direction of the plane of the opening may vary within a given tolerance range, and so may the distance of the frame from the interior wall of the elevator shaft. In addition, there may be angular deviations of the shaft wall and its opening from the vertical and horizontal directions. The threshold fillet which is attached to the frame or possibly belongs to it (not shown in the figures) must be mounted in alignment with the landing floor surface.

Figure 2:
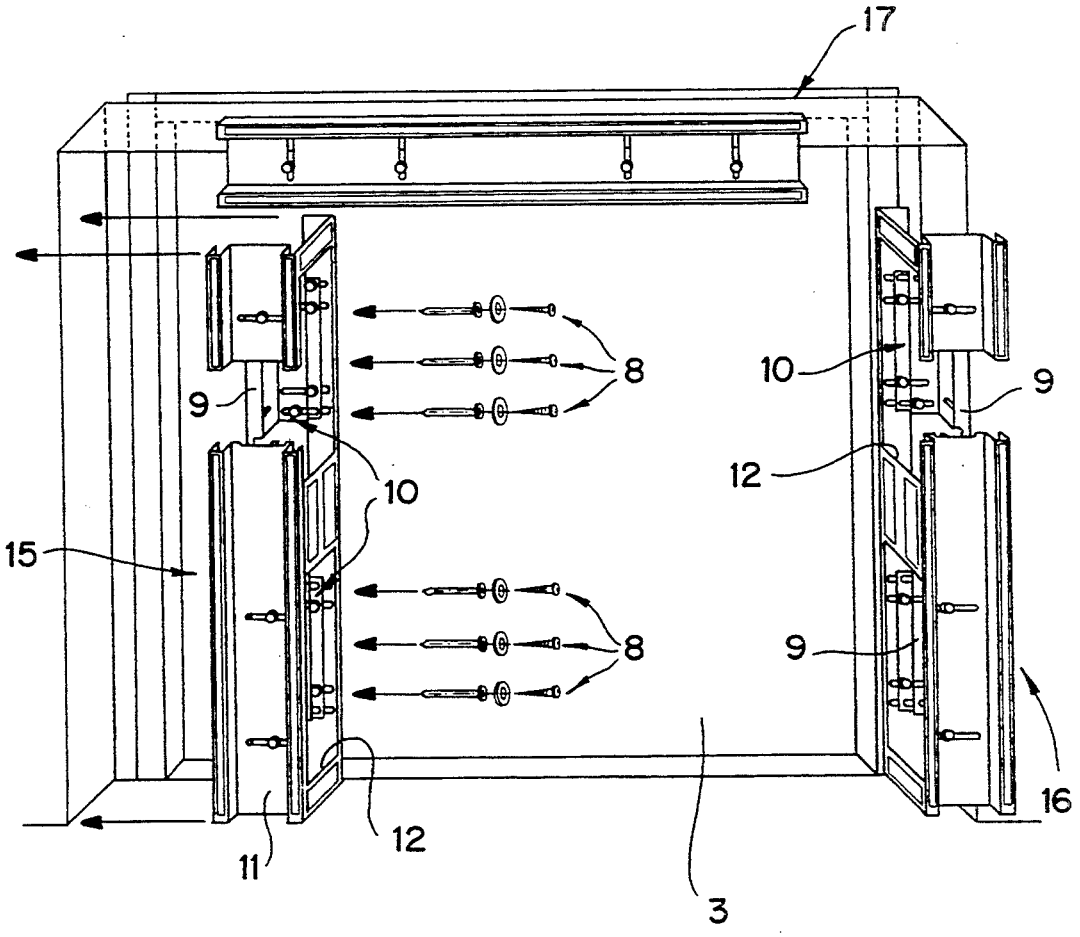
Figure 3:
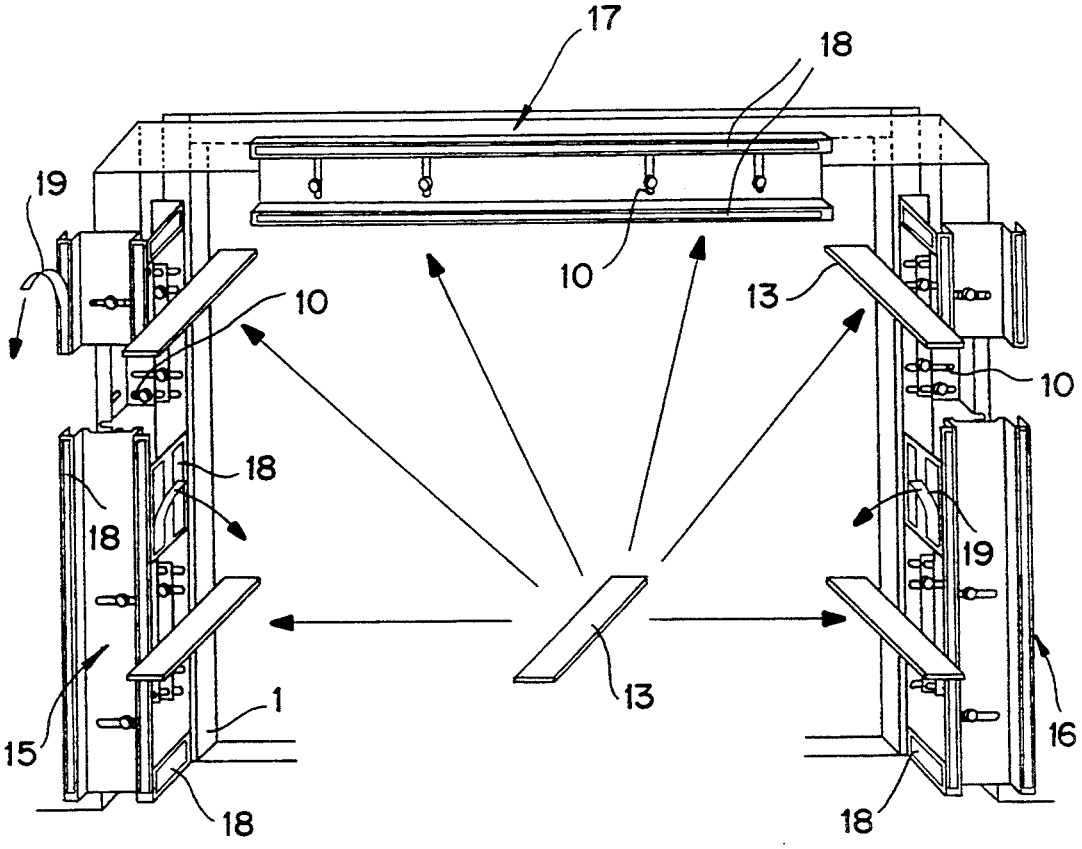
Figure 4:
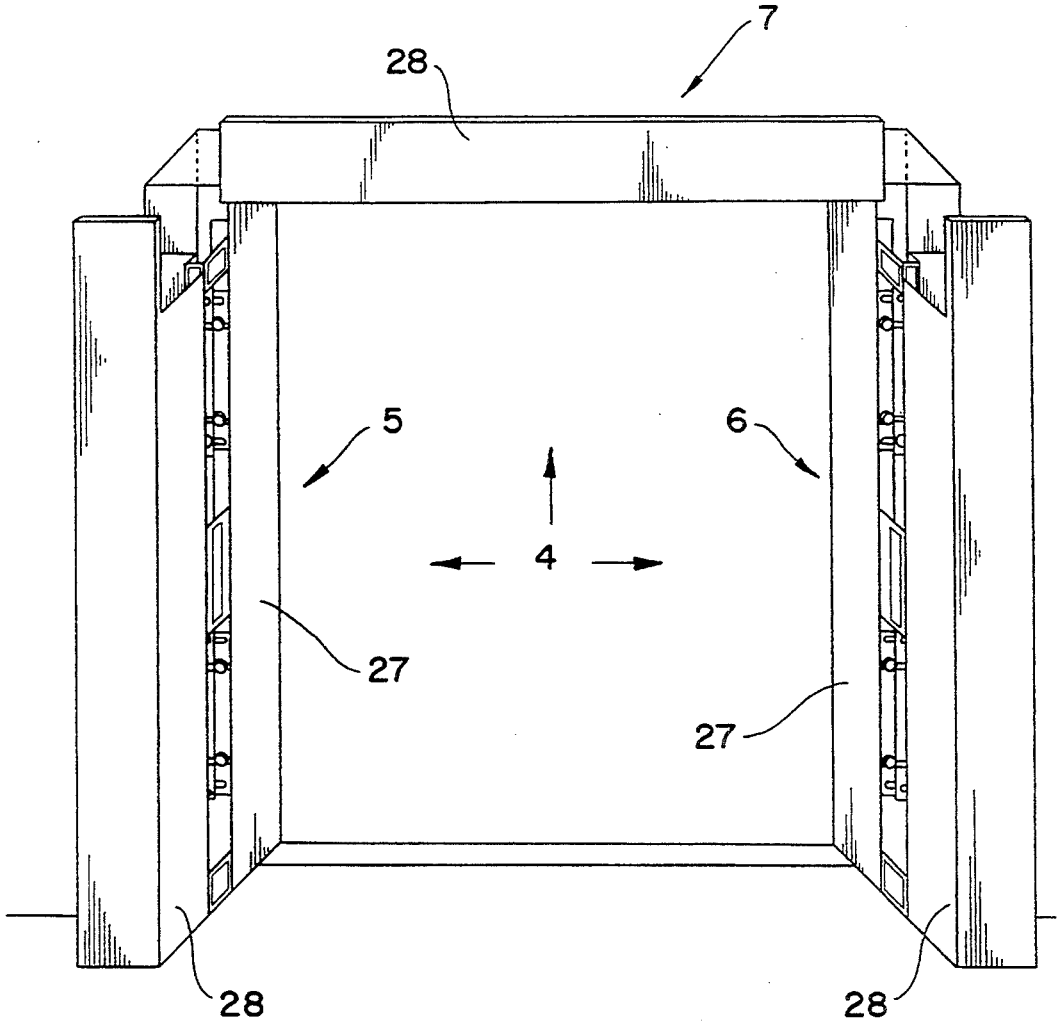

In the following, an embodiment of the jamb structure according to the invention is described. At the same time, a preferred procedure for installing the door jambs is described, using FIGS. 2, 3 and 4 as an aid. The elevator entrance frame 4 of the invention consists of side jambs 5,6 and a horizontal head jamb 7, which are substantially identical in internal construction. The differences between the head and side jambs lie primarily in the shape of the sheet metal cladding at the ends of the head and side jambs (corners of the doorway), which determines the external appearance of the entrance frame, and in the manner in which the surface of the head and side jambs continues in the opening towards the shaft. In a preferred embodiment, the jamb structure is composed of preassembled modules. FIG. 2 shows how the skeletal jamb modules 15,16,17 are mounted in the opening 3. The structure of the skeletal jamb modules 15,16,17 will be described later on. Often it is preferable to make all the skeletal jamb modules somewhat shorter than the lengths of the corresponding parts 5,6,7 of a finished doorway as measured from the inside, so that the parts to be mounted later on the skeletal modules can be easily installed without impediment from adjacent jambs. In FIG. 2, the right-hand side jamb module 16 and the head jamb module 17 have already been mounted in place. Skeletal module 15 is brought to its position against the edge of the shaft wall opening and fixed to the wall 2 with screws 8 by brackets 9, of which there are two pieces for each skeletal module in the example, placed near the ends of the modules. To give a clearer illustration of the structure, FIGS. 2, 3 and 4, show skeletal jamb modules 16,17 and their upper brackets partially sectioned on the side facing towards the landing. Skeletal jamb module 15 consists of an essentially L-shaped skeleton 11, brackets 9 and means 10 for the adjustment of the distance between them. The skeleton is provided with holes 12 placed at the level of the brackets 9. Via these holes, the installer fastens the module to the wall by means of screws 8. The holes also provide an access to the means 10 for distance adjustment. The other skeletal jamb modules 16,17 are constructed in a corresponding manner. After the skeletal jamb modules 15,16,17 have been secured in place, they are adjusted using the distance adjustment means 10 so that the jamb module sides facing towards the door opening are flush with the inner surface of the landing door frame 1 (FIG. 3). In practice, the distance adjustment involves separate adjustment of the shaft-side edge and the landing-side edge of the skeletal jamb module surfaces facing towards the door opening. The adjustment of the distances of the skeletal jamb modules 15,16,17 can be carried out with the aid of a straight-edged plate 13 or ruler, making it easy to fit the aperture formed inside the door frame 1 and that formed between the skeletal jamb modules 15,16,17 so that they are the same size and aligned with each other. Once the skeletal jamb modules 15,16,17 have been installed in their final positions, the distance adjustment means 10 are locked.

To mount the sheet metal claddings onto the skeletal jamb modules, the strips 19 protecting the glue of the tapes 18 on the skeletal jamb modules are removed. The sheet metal claddings 27,28 are mounted in place and pressed against the skeletal jamb modules 15,16,17, causing the claddings to stick in position by means of the tapes (FIG. 4). The assembly of the entrance frame 4 is started by first mounting a sheet metal cladding piece 27 of an L-shaped cross-section on the shaft-side edge of the wall. The cladding sheet 27 covers the door frame at least partially on the shaft-side edge and extends towards the landing so that it can be fixed to the jamb module surface facing towards the inside of the door opening by means of a tape 18 attached to said surface. After the cladding sheets 27 on the shaft-side edge have been mounted, a cladding sheet 28 of an L-shaped cross-section covering the landing-side edge is attached to each skeletal jamb module 15,16,17. Cladding sheet 28 overlaps cladding sheet 27 in the door opening and extends on the landing side over the jamb module. The edges of the landing-side part of at least the cladding sheet 28 on the landing-side edge of the wall are so shaped that, when the sheet 28 is in its final position, they lie tight against the wall surface. Often the two sheets 27 and 28 are attached together by means of a double-sided tape provided in the overlapping portion of the sheets. In this way, the cladding sheets 27,28 forming the surface structure of the jamb system provide a structural adjustment tolerance of up to 30 mm in the thickness-wise direction of the wall for overlapping jamb joints even in the case of walls no thicker than 95 mm. When the structure is applied to a wall of a larger nominal thickness, it is preferable to design the jamb system so that it has a larger adjustment tolerance. In the case of a wall having a thickness of 150 mm, an advantageous adjustment tolerance is about 50 mm in the thickness-wise direction. This order of adjustment tolerances are generally sufficient to meet the need for varying the depth of the entrance frame as required by the constructional inaccuracies of the building.

A functional difference between the skeletal structure 15,16,17 and the cladding structure 27,28 is also that the skeletal structure in general mainly supports the whole jamb structure while the cladding structure at most acts as a stiffener of the skeletal structure. However, it is possible that the cladding structure also provides some support for the jamb structure.

Figure 5:
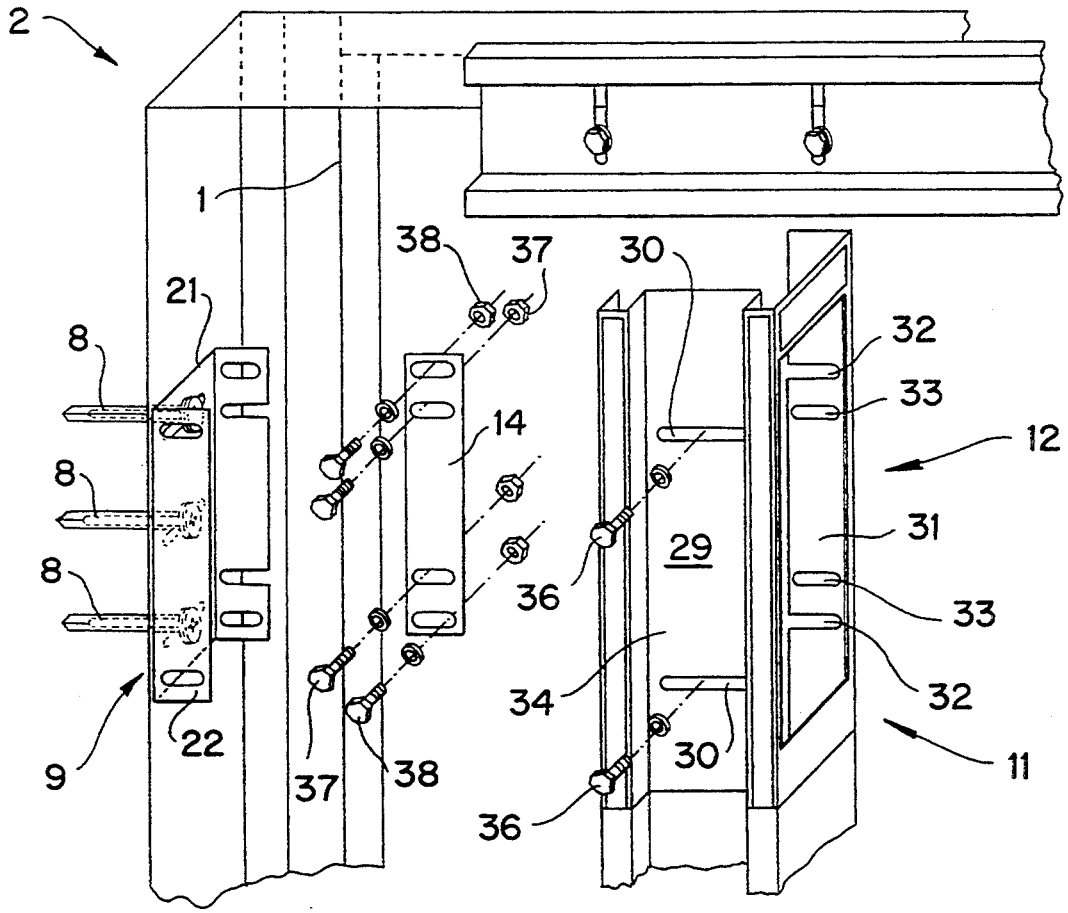
FIG. 5 and 6 present a detail of the jamb system.
Figure 6:
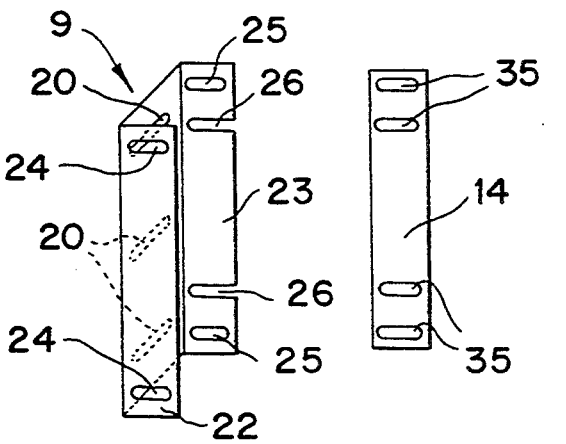

FIG. 5 presents a detail illustrating how the jamb skeleton 11 is fixed to the wall 2. The bracket 9 is fixed to the wall 2 by means of screws 8 screwed into holes provided with plugs. This fixing method is applicable in the case of concrete and brick walls. The bracket 9 can also be attached to the wall by means of wedge or nail anchors or similar fixing methods that may be applicable in each case. The method of fixing the bracket 9 to the wall is chosen according to the wall structure. The bracket 9 is formed from a plate (made e.g. from a 1.5 mm surface-treated sheet metal) provided with perforations by bending the sheet along two lines so as to produce a substantially rectangular channel. The bottom 21 of the channel is provided with holes 20 for fixing screws 8. The holes preferably have an elongated shape so that, before the screws are tightened, the bracket, supported by the screws, can easily be set to a suitable position in the thickness-wise direction of the wall 2 and finally locked in place by tightening the screws. The edges 22,23 of the channel-like bracket 9 are provided with elongated perforations placed close to either end of the channel and oriented in the depth-wise direction of the channel. These perforations preferably consist of two elongated holes 24,25 in each edge 22,23 and, in addition, two elongated slots 26 placed beside the holes 25 in the shaft-side edge 23 of the bracket 9 and oriented towards the bottom of the bracket, with their open end directed away from the channel bottom. The jamb skeleton 11 is made of at least one pre-perforated plate shaped by bending it lengthwise so that it substantially has the form of the letter L in cross-section. Both parts of the L-shaped body are further profiled by bending in their edges. Thus, the skeleton 11 resembles a box beam with one corner removed. The skeleton is placed onto the wall with this missing corner against the arris formed by the landing-side edge of the opening 3 in the wall 2 so that the box beam structure described above surrounds the arris. For the invention, the presence of an arris is not actually presumed, so it can be just as imaginary. The inwards-bent shaft-side edge 31 of the jamb skeleton 11 is provided with at least one pair of elongated slots 32 substantially transverse to the longitudinal direction of the skeleton 11, with their open ends directed towards the removed corner, and elongated holes 33 oriented in the same direction, placed at the same distances from each other as the holes and slots in the bracket edge 23 facing to the shaft, yet so that, in the vertical direction, the position of slot 32 corresponds to that of hole 25 and the position of hole 33 corresponds to that of slot 26. The part 29 of the skeleton 11 extending in the direction of the plane of the wall 2 is provided with at least one pair of elongated holes 30 substantially perpendicular to the longitudinal direction of the skeleton 11, placed at the same vertical distances from each other as the holes 29 in the landing-side edge 22 of the bracket 9. Holes 30 are oriented in the same direction as holes 33 and substantially longer than the latter 33. In a preferable solution, holes 30 are formed in an area 34 of the skeleton where they lie deeper towards the elevator shaft than the outermost surface of part 29. Between the bracket 9 and the skeleton 11 is a plate-like connecting piece 14 provided with elongated holes 35 substantially perpendicular to the lengthwise direction of the connecting piece 14. The number of holes in the connecting piece 14 is equal to the total number of holes and slots in edge 23 of the bracket 9, in this example four. When the connecting piece 14 is placed opposite to the edge 23, each one of holes 35 will be aligned either with a hole 25 or a slot 26.

An adjustable joint between the skeleton 11 and the bracket 9 is made on the landing side by means of a screw-and-nut fastening through holes 24 and 30. On the shaft side, the attachment is made with the aid of plates 14 by fastening some of holes 35 to holes 33 in the skeleton 11 by means of a screw-and-nut fastening 37 and others to holes 25 in the bracket 9 by means of screw-and-nut fastening 38. In this way, a distance adjustment 10 for the attachment of the jamb structure is accomplished, the adjusting elements consisting of two parts 22,29 on the landing side and three parts 23,14,31 on the shaft side. On the shaft side, three parts 23,14,31 overlapping each other are needed to achieve a sufficient distance adjustment range because the wall 2 is often thicker than the skeletal structure of the jamb. The distance adjustment elements 10 form a head joint with the wall 2 on the shaft side, whereas on the landing side they overlap the wall. In a preferred embodiment, the distance adjustment range is 30 mm or more, depending on the width of the landing-side jamb cladding sheet 28.

It is obvious to a person skilled in the art that different embodiments of the invention are not restricted to the example described above, but that they may instead be varied within the scope of the claims presented below. For example, the sheet metal claddings can be fixed to their seats e.g. by glueing or with screws instead of using tape as described above. Also, the exposed part of the jamb structure may be made of a material other than sheet metal as used in the example, or the jamb cladding sheets can be coated partly or completely with another material, e.g. flagstone. It is also obvious to the skilled person that, although each skeletal module can be mounted on the wall using only one bracket of sufficient length, it is preferable to use several adjustable brackets. The most suitable method of fixing the frame modules to the wall is to use two brackets for each module. It is further obvious to the skilled person that the depth adjustment of the jamb structure of the invention can be used to compensate, at least to some extent, the difference of inclination between the shaft wall (door opening) and the line of travel of the elevator, or that the various parts of the jamb cladding structure can be so mounted that the jamb has a different depth at different points.

I claim:

1. A jamb assembly for the landing doors of an elevator in an opening (3) in a wall between the elevator shaft and the landing, comprising a skeletal structure (15,16,17) attachable to the wall (2) and including first means for distance adjustment (10) to allow the skeletal structure to be fitted in place in the opening (3) in the direction of the plane of the wall (2), a surface structure (27,28) attachable to the skeletal structure (15, 16, 17) and including second means for distance adjustment thereof in the direction of the thickness of the wall (2).

2. The jamb assembly according to claim 1, characterized in that the skeletal structure (15, 16, 17) has a plurality of modules, each of said modules having at least one bracket (9) for the affixing thereof to an edge of the opening (3) in the wall (2).

3. The jamb assembly according to claim 2, characterized in that each said module (15,16,17) is attachable to the at least one bracket (9) so that the position of at least one of said modules in the direction of the plane of the door opening (3) is separately adjustable on the shaft side and on the landing side.

4. The jamb assembly according to claim 3, characterized in that, on the shaft side, the first means for distance adjustment includes three parts (23,14,31) overlapping each other and forming a head joint with the wall (2) whereas on the landing side said modules (15,16,17) at least partially overlap the wall (2).

5. A jamb assembly for the landing doors of an elevator in an opening in a wall between the elevator shaft and the landing, comprising a jamb structure, said jamb structure including a skeletal structure attachable to the wall and including first means for distance adjustment to allow the skeletal structure to be fitted in place in the opening in the direction of the plane of the wall, and a surface structure attachable to the skeletal structure, said surface structure including second means of distance adjustment thereof in the direction of the thickness of the wall.

6. The jamb assembly according to claim 5, wherein the skeletal structure has a plurality of modules, each of said modules having at least one bracket for the affixing thereof to an edge of the opening in the wall.

7. The jamb assembly according to claim 6, wherein each said module is attachable to the at least one bracket so that the position of at least one of said modules in the direction of the plane of the door opening is separately adjustable on the shaft side and on the landing side.

8. The jamb assembly according to claim 7, wherein each said bracket includes a side portion, each said module includes a flange portion and the first means of distance adjustment includes the side portion, the flange portion and a plate overlapping each other and forming a head joint with the wall and whereas on the landing side said modules at least partially overlap the wall.

* * * * *